United States Patent [19]

Owen et al.

[11] 4,002,557

[45] Jan. 11, 1977

[54] CATALYTIC CONVERSION OF HIGH METALS FEED STOCKS

[75] Inventors: Hartley Owen, Belle Mead; Paul B. Venuto, Cherry Hill, both of N.J.

[73] Assignee: Mobil Oil Corporation, New York, N.Y.

[22] Filed: Mar. 7, 1975

[21] Appl. No.: 556,251

Related U.S. Application Data

[63] Continuation-in-part of Ser. No. 473,608, May 28, 1974.

[52] U.S. Cl. ..... 208/120; 208/111; 208/251 R; 208/2.51 H; 260/673; 260/676 R

[51] Int. Cl.[2] ..... C10G 11/04; B01J 8/24

[58] Field of Search ..... 208/120; 260/668 R, 260/111

[56] References Cited

UNITED STATES PATENTS

| | | | |
|---|---|---|---|
| 2,999,061 | 9/1961 | Persyn, Jr. | 208/67 |
| 3,506,731 | 4/1970 | Frilette et al. | 260/672 |
| 3,542,668 | 11/1970 | Van Pool | 208/111 |
| 3,617,496 | 11/1971 | Bryson et al. | 208/80 |
| 3,728,408 | 4/1973 | Tobias | 260/668 C |
| 3,758,402 | 9/1973 | Oleck et al. | 208/111 |
| 3,830,724 | 11/1974 | Schutt | 208/111 |
| 3,849,291 | 11/1974 | Owen | 208/78 |
| 3,894,104 | 7/1975 | Chang et al. | 260/668 R |
| 3,894,107 | 7/1975 | Butter et al. | 260/668 R |

*Primary Examiner*—Delbert E. Gantz
*Assistant Examiner*—G. E. Schmitkons
*Attorney, Agent, or Firm*—C. A. Huggett; M. G. Gilman; C. D. Farnsworth

[57] ABSTRACT

The conversion of high metals containing feed stock is accomplished in the presence of a low molecular weight carbon-hydrogen fragment contributing material and an acid function crystalline zeolite catalyst to produce gasoline of high quality and yields superior to that obtained heretofore.

6 Claims, No Drawings

CATALYTIC CONVERSION OF HIGH METALS FEED STOCKS

This application is a continuation-in-part of application Ser. No. 473,608, filed May 28, 1974.

BACKGROUND OF THE INVENTION

It is known in the prior art to upgrade hydrogen deficient petroleum oils to more valuable products by thermal and catalytic cracking operations in admixture with a hydrogen donor diluent material. The hydrogen donor diluent is a material, aromatic-naphthenic in nature that has the ability to take up hydrogen in a hydrogenation zone and to readily release hydrogen to a hydrogen deficient oil in a thermal or catalytic cracking operation.

One advantage of a hydrogen donor diluent operation is that it can be relied upon to convert heavy oils or hydrogen deficient oils at relatively high conversions in the presence of catalytic agents with reduced coke formation. Coke as formed during the cracking operation is usually a hydrocarbonaceous material sometimes referred to as a polymer of highly condensed, hydrogen poor hydrocarbons.

A great demand continues for refinery products, particularly gasoline, fuel oils, and gaseous fuels. Because of the shortage of high quality, clean petroleum-type feedstocks, the refiner now must turn to heavier, more hydrogen-deficient, high impurity-containing cracking feedstocks. Included in this category are heavy vacuum gas oils, atmospheric residua, vacuum tower bottoms, and even syncrudes derived from coal, oil shale, and tar sands, and even coal itself.

In some cases, high levels of nitrogen and sulfur constitute a serious problem in such refractory, low-crackability stocks, particularly with reference to downstream processing and product environmental and pollution limitations. An even more difficult problem is posed by the presence of metallic impurities, nickel, vanadium, iron, etc., preserved through geologic time in heavy petroleum fractions. Such metals, commonly associated with porphyrin rings and asphaltenes in high molecular weight cuts, can cause serious engineering-/hardware problems in catalytic cracking. As catalyst is exposed to repeated cycles of reaction/regeneration in a fluid cat cracker (FCC), these metals are adsorbed and tend to build up with time and accumulate on the catalyst. They then cause dehydrogenation-type reactions, resulting in formation of very large amounts of coke, large amounts of $H_2$ gas, which may put a severe strain on the FCC unit regenerator air blower and wet gas compressor capacity. Further, and very important, their presence is often associated with a serious loss of conversion and gasoline yield.

The present invention is concerned with an improved hydrocarbon conversion operation designed to particularly reduce the hydrogen deficiency as well as the coke forming tendencies of such a catalytic cracking operation.

SUMMARY OF THE INVENTION

The present invention is concerned with providing mobile hydrogen alone or combined with carbon in molecular fragments in a crystalline zeolite hydrocarbon conversion operation in such amounts that the yield of desired hydrocarbon product will be simultaneously increased. In a more particular aspect the present invention is concerned with providing hydrogen contributing materials and/or carbon-hydrogen molecular fragments to a catalytic cracking operation which are lower boiling than a high molecular weight hydrocarbon charged to the cracking operation. In yet another aspect the present invention is concerned with providing the hydrocarbon conversion operation with one or more crystalline zeolite catalytic materials which will promote chemical reactions with mobile hydrogen and/or carbon-hydrogen molecular fragments in addition to promoting catalytic cracking reaction to provide useful products contributing to gasoline boiling range material.

In the present invention large quantities of a "low molecular weight carbon-hydrogen fragment contributing agent or material" and a "high metals content feedstock" are intimately mixed with one another and reacted in the presence of a catalyst with a cracking or acid function such as a crystalline zeolite catalyst comprising an acid function, wherein cracking and additive carbon-hydrogen reactions occur to produce gasoline and other products of (a) quality and (b) yield superior to those formed in the absence of the "low molecular weight carbon-hydrogen fragment contributing material". The cracking and additive reactions may also occur in the presence of a catalyst with a hydrogen activating or hydrogen-transfer function after exposure of the reactant mixture at an elevated temperature to the catalysts herein defined.

A particular advantage of the reaction concepts of this invention is that they occur at low pressures (i.e. at pressures commonly employed in current catalytic cracking operations or slightly higher). It is most preferred that the reactions be performed in fluidized beds (risers, dense beds, etc.), but they can also be practiced in some fixed bed arrangements or moving bed catalytic systems. The reactions described herein may occur in one stage of operation all at the same process conditions, or in a sequence of two or more stages of operation, at the same or different process conditions. Further, the catalyst functions referred to herein may be on the same catalyst particle, or on different catalyst particles such as a mixture of crystalline zeolite catalytic materials.

Some specific advantages derivable from the improved process concept of this invention include crackability of heavy feedstocks, increased gasoline yield and/or gasoline quality (including octane and volatility), and fuel oil fractions of improved yield and/or burning quality and lower levels of potentially polluting impurities such as sulfur and nitrogen. The need for costly high pressure hydrotreaters and hydrocrackers using expensive molecular hydrogen rich gas can thus be eliminated, or the severity requirement of the operation greatly decreased, thus saving considerable capital investment and operating costs.

By "low molecular weight carbon-hydrogen contributing material" is meant materials comprising a lesser number of carbon atoms than found in materials within the gasoline boiling range and preferably those materials containing 5 or less carbon atoms that fit into any of the categories of:

a. Hydrogen-rich molecules, i.e. molecules with wt.% H ranging from about 13.0–25.0 wt.%. This may include light paraffins, i.e. $CH_4$, $C_2H_6$, $C_3H_8$ and other materials.

b. A hydrogen donor molecule, i.e. a molecule whose chemical structure permits or favors intermolecular hydrogen transfer. This includes $CH_3OH$, other low boiling alcohols such as ethanol, n-propanol, isopropanol, n-butanol, isobutanol, etc., aliphatic ethers, other oxygen compounds (acetals, aldehydes, ketones) certain sulfur, nitrogen and halogenated compounds. These would include $C_2$–$C_5$ aliphatic mercaptans, disulfides, thioethers, primary, secondary tertiary amines and alkylammonium compounds, and haloalkanes such as methyl chloride etc.

c. Reactants that chemically combine to generate hydrogen donors or "active" or "nascent" hydrogen, i.e. carbon monoxide, CO, especially CO + $H_2O$, CO + $H_2$, CO + alcohol, CO + olefin, etc.

d. Secondary Reaction Products from materials in categories (a), (b), or (c) above that are hydrogen donors themselves, or transfer hydrogen, or become involved in intermolecular hydrogen transfer in which hydrogen redistribution occurs. This includes olefins, naphthenes, or paraffins.

e. Classes of materials which are structurally or chemically equivalent to those of category (d), notably olefins, etc.

f. A combination of any or all of the materials in categories (a) through (e).

g. Preferred low molecular weight material include methanol and $C_2$ - $C_5$ olefins.

By "high molecular weight feedstock" is meant any material that boils higher than a conventional gasoline end boiling point, i.e. about 11–12 C-number or higher. It is especially preferred that "high molecular weight feedstocks" include catalytic cracking feeds or potential feeds therefor such as distillate gas oils, heavy vacuum gas oils, atmospheric resids, syncrudes (from shale oil, tar sands, coal), pulverized coal and combinations thereof.

By catalyst with a "cracking or acid function" is meant an acidic composition, most preferably a solid, such as a zeolitic cracking catalyst and combinations thereof. A preferred composition includes a crystalline zeolite component (or components) intimately dispersed in a matrix. Zeolites ZSM5 and ZSM5 type and mordenite or dealuminized mordenite or TEA mordenite are preferred with or without the presence of the faujasite type zeolite such as REY.

By "high metals stock" is meant any petroleum type stock (i.e. whole crude, distillate gas oil, heavy vacuum gas oil, atmospheric resid, vacuum resid, syncrude from shale oil, tar sands or coal, etc.) which contains > 1–2 ppm of Ni + V, i.e., which contains more of the metals Ni + V than are customarily considered acceptable (in terms of gasoline yield, compressor limitations or air blower capacity) for efficient operation of a typical, existing, commercial FCC unit.

By catalyst with a "hydrogen-activating function" is meant one of several classes of catalysts which aid in the redistribution or transfer of hydrogen, or which are classified as hydrogen dissociation, hydrogen activation, or hydrogenation catalysts. The catalyst with a "hydrogen-activating function" may or may not contain a metal function. Some of the preferred metal functions are Pt, Ni, Fe, Co, Cr, Th, (or other metal function capable of catalyzing the Fischer-Tropsch or water-gas shift reaction), or Re, W, Mo or other metal function capable of catalyzing olefin disproportionation.

The term "hydrogen transfer" is known in the art of catalytic conversion to characterize the ability to transfer hydrogen other than molecular hydrogen from one type of hydrocarbon to another with a catalyst particularly promoting the transfer. This type of chemical reaction is to be contrasted with hydrogenation catalysts or catalyst components capable of attaching hydrogen to an olefin from gaseous molecular hydrogen.

A group of highly active catalysts particularly suitable for use in the practice of the present invention are zeolitic crystalline aluminosilicates of either natural or synthetic origin having an ordered crystal structure. These crystalline zeolite materials are possessed with a high surface area per gram and are microporous. The ordered structure gives rise to a definite pore size of several different forms. For example, the crystalline zeolite may comprise one having an average pore size of about 5A such as Linde 5A or chabasite or it may be an erionite or an offretite type of crystalline zeolite. A crystalline zeolite with a pore size in the range of 8–1-5–A pore size such as a crystalline zeolite of the "X" or "Y" faujasite type of crystalline material may be used. Mordenite and ZSM-5 type of crystalline aluminosilicates may also be employed. In the process of the present invention it is preferred to use crystalline zeolites having a pore size sufficiently large to afford entry and egress of desired reactant molecules. Thus, the catalyst may be a large pore crystalline zeolite such as an "X" or "Y" faujasite variety or it may be a mixture of large and smaller pore crystalline zeolites. In this regard the mixed crystalline aluminosilicates used in the method of this invention will provide a pore size spread greater than 4 and less than 15 Angstrom units. The small pore zeolite portion of the catalyst may be provided by erionite, offretite, mordenite and ZSM-5 type of crystalline zeolite. Methods of preparing these various crystalline zeolites are the subject of numerous patents now available.

The aluminosilicate active component of the catalyst composite may be varied within relatively wide limits as to the crystalline aluminosilicate employed, cation character, concentration as well as in any added component by precipitation, adsorption and the like. Particularly, important variables of the zeolites employed include the silica-alumina ratio, pore diameter and spatial arrangement of cations.

The crystalline aluminosilicate or crystalline zeolites suitable for use in the present invention may be modified in activity by dilution with a matrix material of significant or little catalytic activity. It may be one providing a synergistic effect as by large molecule cracking, large pore material and act as a coke sink. Catalytically active inorganic oxide matrix material is particularly desired because of its porosity, attrition resistance and stability under the cracking reaction conditions encountered particularly in a fluid catalyst cracking operation. Inorganic oxide gels suitable for this purpose are fully disclosed in U.S. Pat. No. 3,140,253 issued July 7, 1964 and such disclosure is incorporated herein by reference.

The catalytically active inorganic oxide may be combined with a raw or natural clay, a calcined clay, or a clay which has been chemically treated with an acid or an alkali medium or both. The catalyst may also be provided with an amount of iron and/or nickel which materials are known to promote the Fischer-Tropsch reaction. The matrix material is combined with the crystalline aluminosilicate in such proportions that the resulting product contains a minor proportion of up to about 25% by weight of the aluminosilicate material and preferably from about 1% up to about 25 weight percent thereof may be employed in the final composite.

The mobile hydrogen component of the reaction mixture of the present invention may be provided from several different sources, such as the high molecular weight feed and the low molecular weight material, it being preferred to obtain hydrogen moieties from gasiform and vaporous component materials occurring in the operation lower boiling than the hydrocarbon material charged to the cracking operation. Thus, it is proposed to obtain the hydrogen moieties suitable for hydrogen distribution reactions from component and component mixtures selected from the group comprising methanol, dimethylether, CO and water, carbon monoxide and hydrogen, $CH_3SH$, $CH_3NH_2$, $(CH_3)_2NH$, $(CH_3)_3N$, $(CH_3)_4N$ and $CH_3X$, where X is a halide such as fluorine, bromine, chlorine and iodine. Of these hydrogen contributing materials it is preferred to use methanol alone or in combination with either CO alone, or CO and water together. On the other hand, it is contemplated combining light olefinic gaseous products found in pyrolysis gas and the products of catalytic cracking such as ethylene, propylene and butylene with the hydrogen contributing material and/or carbon hydrogen contributing material. In any of these combinations, it is preferred that the mobile hydrogen or the carbon-hydrogen fraction be the product of one or more chemical reactions particularly promoted by a relatively small pore crystalline zeolite such as a ZSM-5 type of crystalline zeolite or a small pore mordenite type zeolite. Methanol is a readily available commodity obtained from CO and $H_2$ synthesis, coal gasification, natural gas conversion, and other known sources.

Current practice for upgrading high molecular weight, hydrogen-deficient, high-impurity refinery stocks generally involves either hydrotreating followed by catalytic cracking, or hydrocracking, both of which involve the use of costly gaseous hydrogen at high pressures (i.e. 500–3000 psig), in expensive, high-pressure process units. Alternately some poor quality stocks are catalytically cracked alone with low quality product being produced which requires extensive upgrading or dilution before becoming saleable. Some of these processes often require expensive gas compressors and complex heat transfer or hydrogen-quenching systems. In addition, although these processes improve conversion and product yields, significant losses in gasoline octane are often incurred, requiring a subsequent reforming step to upgrade gasoline quality.

The current concept employs a fluidized catalyst system at low pressures without the need for high pressure hydrogen gas. Such a system promotes the highly efficient contact of relatively inexpensive hydrogen contributing low molecular weight materials with heavy, refractory molecules in the presence of high-surface area cracking catalyst with or without "hydrogen-activating catalyst functions". Intermolecular hydrogen-transfer interactions and catalytic cracking reactions effected in the presence of fluidized catalyst particles minimize problems due to diffusion/mass transport limitations and/or heat transfer.

The concepts of the present invention make use of relatively cheap, low molecular weight hydrogen contributors readily available in petroleum refineries, such as light gas fractions, light olefins, low boiling liquid streams, etc. It also makes particular use of methanol, a product which is readily available in quantity, either as a transportable product from overseas natural gas conversion processes, or as a product from large scale coal, shale, or tar sand gasification. It also can utilize carbon monoxide (in combination with hydrogen contributors such as water or methanol), which gas is readily available from refinery regeneration flue gas (or other incomplete combustion processes), or from coal, shale or tar sand gasification. Highly efficient recycle or unused hydrogen contributors can also be effected.

A particularly attractive feature of this invention is concerned with converting whole crude hydrocarbon materials. That is, a whole crude may be utilized as the charge with the light end portion thereof constituting a part of the "low molecular weight hydrogen contributor" alone or in combination with added methanol or other hydrogen contributing light materials and the heavier end portion of the whole crude constituting the "high molecular weight feedstock".

It is anticipated that as a result of the processing concepts herein defined, requirements for reforming and alkylation can be greatly reduced, thus saving the petroleum refiner investment and operating cost.

The combination reactions comprising this invention are effective in removing sulfur, oxygen, nitrogen and metal contaminants found in a whole crude or a heavy hydrocarbon portion thereof.

The chemical-conversion operation of this invention is accomplished at temperatures within the range of 400° F. up to about 1200° F. and more usually within the range of 700° F. to about 1100° F. at pressures selected from within the range of below atmospheric up to several hundred pounds but normally less than 100 psig. Preferred conditions include a temperature within the range of about 800° F. to about 1000° F. and pressures within the range of atmospheric to about 100 psig.

In an operation embodying the concepts of this invention using methanol in combination with a gas oil type of hydrocarbon charge stock, a ratio of methanol to hydrocarbon charge passed to the cracking or conversion operation will vary considerably and may be selected from within the range of from about 0.01 to about 5, it being preferred to maintain the ratio within the range of about 0.05 to about 0.30 on a stoichiometric weight basis. However, this may vary depending upon the hydrogen deficiency of the high molecular weight hydrocarbon charge, the amount of sulfur, nitrogen and oxygen in the oil charge, the amount of polycyclic aromatics, the type of catalyst employed, and the level of conversion desired. It is preferred to avoid providing any considerable or significant excess of methanol with the charge because of its tendency to react with itself under some conditions.

In a specific embodiment, this invention includes the catalytic cracking of high boiling residual hydrocarbons in the presence of hydrogen and carbon-hydrogen contributing materials in the presence of crystalline zeolite conversion catalysts particularly performing the chemical reactions of cracking, hydrogen redistribution, olefin cyclization and chemical reaction providing mobile hydrogen in one of several different forms and suitable for completing desired hydrogen transfer reactions. The chemical reactions desired are particularly promoted by a mixture of large and small pore crystalline zeolites in the presence of hydrogen donor materials such as methanol or a mixture of reactants which will form methanol under, for example, Fischer-Tropsch, or other processing conditions. The conditions of cracking may be narrowly confined within the ange of 900° F to 1100° F at a hydrocarbon residence ime within the range of 0.5 second to about 5 minutes. 'he catalyst employed is selected from a rare earth xchanged "X" or "Y" faujasite type crystalline zeolite naterial, a Mordenite or ZSM-5 type crystalline zeolite ither component of which is employed alone in an mount within the range of 2 weight percent up to bout 15 weight percent dispersed in a suitable matrix naterial. The faujasite and mordenite crystalline zeoites may be employed alone or in admixture with a ZSM-5 type of crystalline zeolite supported by the ame matrix or by a separate silica-clay matrix containing material.

DISCUSSION OF SPECIFIC EMBODIMENTS

EXAMPLE 1

A heavy vacuum gas oil (HVGO) was used as the ydrocarbon feed in the cracking operations of the ollowing examples and provided the following inspecions: API gravity (60° F) 20.3; refractive index, .5050; average molecular weight 404; weight percent ydrogen, 11.81; weight percent sulfur, 2.69; weight ercent total nitrogen, .096; basic nitrogen (p.p.m.), 84; metals; less than 2 p.p.m.; boiling range, 748° F. 10%) - 950° F. (90%). The methanol used with the ydrocarbon feed in comparative runs was C.P. grade nethanol.

In run B of Table I presented below, a mixture of methanol (16.5 weight percent based on HVGO) and (HVGO) heavy vacuum gas oil identified above were pumped from separate reservoirs to the inlet of a feed preheater of a 30 ft. bench scale riser FCC unit. The feed materials were intimately mixed in the feed preheater at 790° F and then admitted to the riser inlet, where the hot (1236° F) equilibrium catalyst (15 wt.% REY) (67.5 FAI) (fluid activity index) was admitted and catalytic reaction allowed to occur. The catalyst Fluid Activity Index (FAI) is defined as the conversion obtained to provide a 356° F. 90% ASTM gasoline product processing a Light East Texas Gas Oil (LETGO) at a 2 c/o, 850° F. 6 WHSV for 5 minutes on stream time. Conversion is defined as 100-cycle oil product. The riser reactor inlet and mix temperature were 1000° F., ratio of catalyst to oil (Oil = HVGO + $CH_3OH$) by weight was 4.07, catalyst residence time was 4.8 sec., riser inlet pressure was 30 psig, and ratio of catalyst residence time to oil residence time (slip) was 1.26. The riser effluent was passed through a steam stripping chamber, and the gaseous effluent was separated from spent catalyst (1.02 weight percent carbon). The gaseous and liquid products were collected and separated by distillation and analyzed. Data for the operating conditions and mass balance are shown in Table I below.

Table I-A

Heavy Vacuum Gas Oil With/Without Methanol
Reaction Conditions and Mass Balance
15% REY Catalyst

| | Run A | Run B |
|---|---|---|
| OPERATING CONDITIONS | | |
| Reactor Inlet Temp., ° F. | 1000 | 1000 |
| Oil Temp., ° F. | 790 | 790 |
| Catalyst Inlet Temp., ° F. | 1236 | 1237 |
| Catalyst/Oil (Wt/Wt) Ratio[b] | 3.96 | 4.07 |
| Catalyst Residence Time, Sec. | 4.87 | 4.80 |
| Reactor Pressure, Inlet, psig | 30 | 30 |
| Carbon, Spent Catalyst, % Wt. | .963 | 1.022 |
| Sulfur, Spent Catalyst, % Wt. | .0173 | .0204 |
| Slip Ratio | 1.27 | 1.26 |
| Catalyst | ← 15% REY → | |
| | FAI 67.5, burned white | |
| YIELDS (NLB ON TOTAL FEED) | | |
| Conversion, % Vol.[a] | 65.23 | 63.20 |
| $C_{5+}$ Gasoline, % Vol. | 53.53 | 50.06 |
| Total $C_4$, % Vol. | 13.03 | 9.90 |
| Dry Gas, % Wt. | 7.36 | 9.92 |
| Coke, % Wt. | 4.11 | 4.82 |
| Gaso. Efficiency, % Vol. | 82.06 | 79.2 |
| Gasoline R+O, Raw Octane | 87.8 | 89.5 |
| $H_2$ Factor | 27 | 15 |
| Recovery, % Wt. | 96.83 | 102.49[c] |
| Wt. % $CH_3OH$, % of Heavy Vacuum Gas Oil | — | 16.5 |
| Molar ratio, $CH_3OH$/HVGO | — | ~2.1 |

[a]356° F. at 90 % cut point
[b]On $CH_3OH$ + HVGO
[c]Includes added mass from $CH_3OH$ reaction.

| Detailed Mass Balance[a] | | |
|---|---|---|
| $H_2S$, % Wt. | .58 | .10 |
| $H_2$, % Wt. | .05 | .08 |
| $C_1$, % Wt. | .89 | 3.83 |
| $C_2^=$, % Wt. | .56 | .84 |
| $C_2$, % Wt. | .75 | .92 |
| $C_3^=$, % Vol. | 6.26 | 5.75 |
| $C_3$, % Vol. | 1.86 | 1.67 |
| $C_4^=$, % Vol. | 7.28 | 6.67 |
| i- $C_4$, % Vol. | 4.65 | 2.53 |
| n- $C_4$, % Vol. | 1.10 | 0.71 |
| $C_5^=$, % Vol. | 5.54 | 5.33 |
| i- $C_5$, % Vol. | 4.36 | 2.29 |
| n- $C_5$, % Vol. | 0.89 | 0.58 |
| $C_{5+}$ Gaso., % Vol. | 53.53 | 50.06 |
| Cycle Oil, % Vol. | 34.77 | 36.85 |

Table I-A-continued

| Heavy Vacuum Gas Oil With/Without Methanol Reaction Conditions and Mass Balance 15% REY Catalyst | Run A | Run B |
|---|---|---|
| Coke, % Wt. | 4.11 | 4.82 |

[a]Note: Selectivities are based on total products arising from methanol + HVGO reaction.

Table I-B

| Gasoline Inspections | Run A | Run B |
|---|---|---|
| Sp. Grav., 60° F. | .7495 | .7491 |
| API Grav., 60° F. | 57.3 | 57.4 |
| Alkylates % Vol. | 22.63 | 18.18 |
| $C_5$+ Gasoline + alkylate, % Vol. | 76.16 | 59.29 |
| Outside i-$C_4$ required, % Vol. | 10.65 | 10.04 |
| R+O Octane No., Raw | 87.8 | 89.5 |
| Hydrocarbon Types $C_5$- Free, vol. % | | |
| Paraffins | 33.1 | 18.9 |
| Olefins | 24.1 | 43.6 |
| Naphthenes | 12.1 | 7.2 |
| Aromatics | 30.2 | 30.2 |
| Distillation, ° F. | | |
| 10% | 79 | 94 |
| 50% | 222 | 233 |
| 90% | 349 | 363 |

A control run A presented in Table I was made with the identified HVGO alone (no methanol present) in the same manner identified above with Run B. Analysis of the comparative data obtained with the REY catalyst show the following improvements associated with the use of methanol as a "low molecular weight hydrogen donor" when intimately mixed with and cracked with HVGO in a riser fluid catalyst cracking operation.

1. Much higher levels of aromatics + olefins in the gasoline (aromatics and olefins are the major contributors to octane number in gasoline).
2. Higher octane (89.5 R+O with $CH_3OH$ vs 87.8 R+O without $CH_3OH$).
3. Lower percent sulfur in fuel oil (4.24 wt.% with $CH_3OH$ vs 4.45 wt.% without $CH_3OH$).
4. Higher percent hydrogen in fuel oil (9.18 wt.% with $CH_3OH$ vs. 8.21 wt.% without $CH_3OH$).
5. Higher naphthene/aromatic ratios in fuel oil(0.10 with methanol vs. 0.08 without methanol).
6. Higher ratios of Diaromatics/Benzothiophenes (4.55 with $CH_3OH$, 3.65 without $CH_3OH$); this indicates that increased desulfurization occurs with methanol.

EXAMPLE 2

In this example, the heavy vacuum gas oil identified in Example 1 was cracked with and without the presence of methanol with a catalyst mixture comprising a 2% REY crystalline zeolite in combination with a 10% ZSM-5 crystalline zeolite and supporting matrix (silica-clay). The method of operation was carried out similarly to that identified with respect to Example 1. Table II-A below provides the reaction conditions and mass balance obtained for Runs C (no methanol) and Run D (with methanol). Table II-B provides the gasoline inspection data for runs C and D and Table II-C provides the cycle oil inspection data for these two runs.

Table I-C

| Cycle Oil Inspections | Run A | Run B |
|---|---|---|
| Sp. Grav., 60° F. | .9984 | .9746 |
| API Grav., 60° F. | 10.23 | 13.69 |
| Sulfur, % Wt. | 4.45 | 4.24 |
| Hydrogen, % Wt. | 8.21 | 9.18 |
| Hydrocarbon Type, Wt.% | | |
| Paraffins | 7.3 | 8.8 |
| Mono-naphthenes | 2.3 | 2.5 |
| Poly-naphthenes | 4.4 | 5.9 |
| Aromatics | 86.1 | 82.8 |
| Naphthene/Aromatic/wt/wt/ratio | .078 | 0.10 |
| Distillation, ° F. | | |
| 10% | 470 | 429 |
| 50% | 695 | 540 |
| 90% | 901 | 794 |
| Aromatic Breakdown, Normalized, Wt. -% | | |
| Mono-aromatics | 17.9 | 26.3 |
| Di-aromatics | 37.2 | 37.8 |
| Tri-aromatics | 10.1 | 9.1 |
| Tetra-aromatics | 8.3 | 5.5 |
| Pento-aromatics | 1.3 | 1.1 |
| Sulfur Compounds | | |
| Benzothiophene | 10.2 | 8.3 |
| Dibenzothiophene | 10.4 | 6.2 |
| Naphthobenzothiophene | 4.6 | 3.3 |
| Other | 0.2 | 2.4 |
| Ratio, Diaromatics/Benzothiophene | 3.65 | 4.55 |

Table II-A

| Reaction Conditions and Mass Balance | Run C | Run D |
|---|---|---|
| OPERATING CONDITIONS | | |
| Reactor Inlet Temp., ° F. | 900 | 900 |
| Oil Temp., ° F. | 500 | 500 |
| Catalyst Inlet Temp., ° F. | 1100 | 1102 |
| Catalyst/Oil (Wt/Wt) Ratio | 6.68 | 6.81[a] |
| Catalyst Residence Time, Sec. | 4.70 | 6.11 |
| Reactor Pressure, Inlet, psig. | 30 | 30 |
| Carbon, Spent Catalyst, % Wt. | .285 | .342 |
| Sulfur, Spent Catalyst, % Wt. | .0091 | .0006 |
| Slip Ratio | 1.24 | 1.24 |
| Catalyst | ← 2% REY | +10 % ZSM-5 → |
| YIELDS (NLB ON TOTAL FEED) | | |
| Conversion, % Vol.[a] | 44.16 | 42.66[b] |
| $C_5$+ Gasoline, % Vol. | 33.12 | 35.15 |
| Total $C_4$, % Vol. | 12.04 | 6.59 |
| Dry Gas, % Wt. | 5.47 | 5.29 |
| Coke, % Wt. | 2.08 | 2.83 |
| Gaso. Efficiency, % Vol. | 75.0 | 82.39 |

Table II-A-continued

| Reaction Conditions and Mass Balance | Run C | Run D |
|---|---|---|
| Gasoline R+O, Raw Octane No. | — | — |
| $H_2$ Factor | 99 | 25 |
| Recovery, % Wt. | 94.9 | 95.10 |
| *356° F. at 90% cut point (a) on $CH_3OH$ + HVGO (b) based on HVGO only | | |
| Wt.% $CH_3OH$, % of Heavy-72-D-611 Vacuum Gas Oil | — | — |
| Molar Ratio, $CH_3OH$/HVGO | — | ~2.1 |
| Detailed Mass Balance | | |
| $H_2S$, % Wt. | .19 | .09 |
| $H_2$, % Wt. | .06 | .06 |
| $C_1$, % Wt. | .19 | 1.68 |
| $C_2$=, % Wt. | .20 | .33 |
| $C_2$, % Wt. | .22 | .36 |
| $C_3$=, % Vol. | 7.47 | 4.60 |
| $C_3$, % Vol. | .80 | .34 |
| $C_4$=, % Vol. | 8.13 | 5.00 |
| i-$C_4$, % Vol. | 3.34 | 1.13 |
| n-$C_4$, % Vol. | .57 | .46 |
| $C_5$=, % Vol. | 5.82 | 3.98 |
| i-$C_5$, % Vol. | 2.45 | 1.05 |
| n-$C_5$, % Vol. | .51 | .23 |
| $C_5$+ Gaso., % Vol. | 33.12 | 35.15 |
| Cycle Oil, % Vol. | 55.84 | 57.34 |
| Coke, % Wt. | 2.08 | 2.83 |
| Gaso./coke(wt/wt) Ratio | 12.82 | 10.14 |
| Gaso./gas | 4.87 | 5.43 |

Table II-B

| GASOLINE INSPECTIONS | Run C | Run D |
|---|---|---|
| Sp. Grav., 60° F. | .7487 | .7620 |
| API Grav., 60° F. | 57.5 | 54.2 |
| Alkylate, % Vol. | 26.05 | 16.03 |
| $C_5$+ Gaso.+ Alky., % Vol. | 59.17 | 51.19 |
| Outside i-$C_4$ Required, % Vol. | 14.26 | 9.69 |
| R+0 Octane No., Raw | — | — |
| Hydrocarbon Type, $C_5$-Free, Vol.% | | |
| Paraffins | 23.6 | 10.4 |
| Olefins | 32.4 | 57.3 |
| Naphthenes | 18.1 | 5.9 |
| Aromatics | 25.7 | 26.4 |
| Distillation, ° F. | | |
| 10% | — | — |
| 50% | — | — |
| 90% | — | — |

Table II-C

| Cycle Oil Inspections | Run C | Run D |
|---|---|---|
| Sp. Grav., 60° F. | .9701 | .9580 |
| API Gravity, 60° F. | 14.4 | 16.2 |
| Sulfur, % Wt. | 4.04 | 3.39 |
| Hydrogen, % Wt. | 10.13 | 10.64 |
| Hydrocarbon Type, Wt. % | | |
| Paraffins | 15.7 | 16 |
| Mono-naphthenes | 6.9 | 7.8 |
| Poly-naphthenes | 9.2 | 10.1 |
| Aromatics | 68.3 | 66.2 |
| Naphthene/Aromatic (Wt/Wt) Ratio | .23 | .27 |
| Distillation, ° F. | | |
| 10% | 536 | 518 |
| 50% | 791 | 756 |
| 90% | 921 | 900 |
| Aromatic Breakdown, Normalized, Wt.% | | |
| Mono-aromatics | 23.4 | 34.2 |
| Di-aromatics | 29.0 | 32.1 |
| Tri-aromatics | 11.0 | 10.0 |
| Tetra-aromatics | 8.9 | 5.5 |
| Penta-aromatics | 1.9 | .9 |
| Sulfur Compounds | | |
| Benzothiophenes | 8.7 | 6.7 |
| Dibenzothiophenes | 8.3 | 5.6 |
| Naphthobenzothiophenes | 5.3 | 2.0 |
| Other | 3.8 | 2.9 |
| Ratio, Diaromatics/Benzothiophene | 3.33 | 4.79 |

It will be observed from Table II-A above that the conversion of the heavy gas oil feed with methanol produced significantly higher yields of $C_5$+ gasoline at a slightly lower conversion level than occurred in the control Run A for comparative purposes. Furthermore, the yield of $C_4$'s was lower, and the gasoline efficiency was much higher with methanol in the feed. An examination of the mass balance yields shows the methanol operation to be associated with higher gasoline and fuel oil yields at the expense of $C_4$ and lower boiling hydrocarbons. Also from the gasoline product inspection Table II-B, it is evident that the gasoline product of the methanol operation will be of a higher octane rating than the gasoline product of Run C, because of increased yields of olefins and aromatics. On the other hand, the cycle oil inspection data of Table II-C, shows lower sulfur compounds in the product of Run C (with methanol); a higher hydrogen content, a higher naphthene to aromatic ratio; less polycyclics and higher aromatics and a higher ratio of diaromatics/benzothiophene indicating that hydrogen transfer has occurred thus producing a better fuel.

EXAMPLE 3

In this example, the heavy vacuum gas oil identified in Example 1 was converted in the presence of methylal which is a methyl ether of formaldehyde: $(CH_3O)_2CH_2$. The catalyst employed was a mixture comprising 2% REY crystalline zeolite in combination with 10% ZSM-5 type of crystalline zeolite supported by a silica-clay matrix. The method of operation was performed in the same manner identified in Example 1 at the operating conditions provided in Table III below. In the table comparative runs are shown with no promoter Run C and methanol promoter Run D.

Table III-A

Comparison of Reacting HVGO with Methylal and with/without Methanol Reaction Conditions and Mass Balance

| | Run C (c) | Run E (b) | Run D |
|---|---|---|---|
| OPERATING CONDITIONS | | | |
| Reactor Inlet Temp., ° F. | 900 | 900 | 900 |
| Oil Temp., ° F. | 500 | 500 | 500 |
| Catalyst Inlet Temp., ° F. | 1110 | 1102 | 1102 |
| Catalyst/Oil (Wt/Wt) Ratio | 6.68 | 6.72 (b) | 6.81 (d) |
| Catalyst Residence Time, Sec. | 4.70 | 6.02 | 6.11 |
| Reactor Pressure, Inlet, psig | 30 | 30 | 30 |
| Carbon, Spent Catalyst, % Wt. | .285 | .601 | .342 |
| Sulfur, Spent Catalyst, % Wt. | .0091 | .0145 | .0006 |
| Slip Ratio | 1.24 | 1.28 | 1.24 |
| Catalyst | | 2% REY + 10% ZSM-5 | |
| YIELDS (NLB ON TOTAL FEED) (e) | | | |
| Conversion, % Vol.[a] | 44.16 | 42.14 | 42.66 |
| $C_5$+ Gasoline, % Vol. | 33.12 | 31.51 | 35.15 |
| Total $C_4$, % Vol. | 12.04 | 6.46 | 6.59 |
| Dry Gas, % Wt. | 5.47 | 5.78 | 5.29 |
| Coke, % Wt. | 2.08 | 4.90 | 2.83 |
| Gaso. Efficiency, % Vol. | 75.0 | 74.8 | 82.39 |
| Gasoline R+O, Raw Octane No. | — | — | — |
| $H_2$ Factor | 99 | 18 | 25 |
| Recovery, % Wt. | 94.9 | 98.1 | 95.10 |
| Wt. % Promoter % of HVGO | 0 | 16.0 | 16.0 |
| Molar Ratio, Promoter/HVGO | 0 | 0.85 | 2.1 |
| Detailed Mass Balance | | | |
| $H_2S$, % Wt. | .19 | 0.1 | .09 |
| $H_2$, % Wt. | .06 | .05 | .06 |
| $C_1$, % Wt. | .19 | 1.89 | 1.68 |
| $C_2$=, % Wt. | .20 | .35 | .33 |
| $C_2$, % Wt. | .22 | .42 | .36 |
| $C_3$=, % Vol. | 7.47 | 4.04 | 4.60 |
| $C_3$, % Vol. | .80 | 1.28 | .34 |
| $C_4$=, % Vol. | 8.13 | 4.83 | 5.00 |
| i-$C_4$, % Vol. | 3.34 | 1.27 | 1.13 |
| n-$C_4$, % Vol. | .57 | .36 | .46 |
| $C_5$=, % Vol. | 5.82 | 3.88 | 3.98 |
| i-$C_5$, % Vol. | 2.54 | 1.34 | 1.05 |
| n-$C_5$, % Vol. | .51 | .22 | .23 |
| $C_5$+ Gaso., % Vol. | 33.12 | 31.51 | 35.15 |
| Cycle Oil, % Vol. | 55.84 | 57.86 | 57.34 |
| Coke, % Wt. | 2.08 | 4.90 | 2.83 |

(a) 356° F. at 90% cut point.
(b) Methylal = methyl ether of formaldehyde
(c) Control Run - no promoter
(d) On promoter + HVGO (heavy vacuum gas oil)
(e) On HVGO feed only.

Table III-B

| Gasoline Inspections | Run C | Run E | Run D |
|---|---|---|---|
| Sp. Grav., 60° F. | .7487 | .7580 | .7620 |
| API Grav., 60° F. | 57.5 | 55.18 | 54.2 |
| Alkylate, % Vol. | 26.05 | 14.84 | 16.03 |
| $C_5$+ Gaso. + Alky., % Vol. | 59.17 | 46.35 | 51.19 |
| Outside i-$C_4$ Required % Vol. | 14.26 | 8.72 | 9.69 |
| R+O Octane No. Raw | — | — | — |
| Hydrocarbon Type, $C_5$-Free Vol.% | | | |
| Paraffins | 23.6 | 11.8 | 10.4 |
| Olefins | 32.4 | 49.9 | 57.3 |
| Naphthenes | 18.1 | 6.3 | 5.9 |
| Aromatics | 25.7 | 32.0 | 26.4 |
| Distillation, ° F. | | | |
| 10% | — | — | — |
| 50% | — | — | — |
| 90% | — | — | — |

Table III-C

| Cycle Oil Inspections | Run C | Run E | Run D |
|---|---|---|---|
| Sp. Grav., 60° F. | .9701 | .9594 | .9580 |
| API Gravity, 60° F. | 14.4 | 16.0 | 16.2 |
| Sulfur, % Wt. | 4.04 | 3.306 | 3.39 |
| Hydrogen, % Wt. | 10.13 | 10.57 | 10.64 |
| Hydrocarbon Type, Wt.% | | | |
| Paraffins | 15.7 | 15.5 | 16 |
| Mono-naphthenes | 6.9 | 7.6 | 7.8 |
| Poly-naphthenes | 9.2 | 9.7 | 10.1 |
| Aromatics | 68.3 | 67.3 | 66.2 |
| Naphthene/Aromatic (Wt/Wt) Ratio | .23 | 0.26 | .27 |
| Distillation, ° F. | | | |

Table III-C-continued

| Cycle Oil Inspections | Run C | Run E | Run D |
|---|---|---|---|
| 10% | 536 | 523 | 518 |
| 50% | 791 | 749 | 756 |
| 90% | 921 | 903 | 900 |
| Aromatic Breakdown, Normalized, Wt.% | | | |
| Mono-aromatics | 23.4 | 29.2 | 34.2 |
| Di-aromatics | 29.0 | 32.2 | 32.1 |
| Tri-aromatics | 11.0 | 11.1 | 10.0 |
| Tetra-aromatics | 8.9 | 6.0 | 5.5 |
| Penta-aromatics | 1.9 | 1.2 | 0.9 |
| Sulfur Compounds | | | |
| Benzothiophenes | 8.7 | 6.9 | 6.7 |
| Dibenzothiophenes | 8.3 | 5.6 | 5.6 |
| Naphthobenzothiophenes | 5.3 | 3.1 | 2.0 |
| Other | 3.8 | 4.6 | 2.9 |
| Ratio, Diaromatics/Benzothiophene | 3.33 | 4.67 | 4.79 |

It will be observed upon examination of the data of Table III that a significant improvement in gasoline quality and cycle oil quality is obtained with either methylal or methanol as a promoter. The gasoline product is shown to have much lower paraffins, much higher olefins and much higher aromatics than obtained by Run C with no promoter. Therefore the gasoline product obtained with the promoter is of a higher octane.

The cycle oil product inspection shows lower sulfur and higher hydrogen in the product of Runs E and D using methylal and methanol as a promoter. In addition there is a higher naphthene/aromatic ratio, lower amounts of the higher molecular weight polyaromatics, more monoaromatics, higher ratio of diaromatics to benzothiophenes - all of which indicate a better quality of fuel oil.

Table 4

| Description | Inspections, 650+ Atmospheric Resid | Distillation | | |
|---|---|---|---|---|
| Physical Properties | | IBP, | ° F. | 531 |
| Gravity, API, 60° F. | 18.8 | 5 Vol. %, | ° F. | 605 |
| Sp. Gravity, 60° F. | .9415 | 10 Vol. %, | ° F. | 634 |
| Aniline Point, ° F. | | 20 Vol. % | ° F. | — |
| Bromine Number | | 30 Vol. %, | ° F. | 713 |
| Pour Point, ° F. | | 40 Vol. %, | ° F. | — |
| KV, 210° F. cs | | 50 Vol. %, | ° F. | 790 |
| Carbon Residue, Wt. %, CCR | | 60 Vol. %, | ° F. | — |
| Carbon Residue, Wt. %, RCR | | 70 Vol. %, | ° F. | 871 |
| Refractive Index, 70° C. | 1.513 | 80 Vol. %, | ° F. | — |
| Density, 70° C. | .9067 | 90 Vol. %, | ° F. | 965 |
| Molecular, Wt. (V.P.) | 461 | 95 Vol. %, | ° F. | 999 |
| | | EP Vol. %, | ° F. | 1041 |
| Chemical Analyses | | | | |
| Hydrogen, % Wt. | 11.48 | | | |
| Sulfur, % Wt. | 2.79 | | | |
| Nitrogen, % Wt. | .14 | | | |
| Metals, ppm | | | | |
| Nickel | 6.3 | | | |
| Vanadium | 2.4 | | | |
| Molecular Type, Wt.% | | | | |
| Paraffins | 18.5 | | | |
| Naphthenes | 18.7 | | | |
| Aromatics | 62.8 | | | |

Table 5

Reaction of light Arab Resid With Cis-2-Butene and With Methanol Over Zeolite Catalysts

| Reaction Conditions | H-595 | H-596 | H-617 |
|---|---|---|---|
| Reactor Inlet Temp., ° F. | 1000 | 1000 | 1000 |
| Oil Feed Temp., ° F. | 515 | 510 | 790 |
| Catalyst Inlet Temp., ° F. | 1250 | 1240 | 1065 |
| Catalyst/Oil (wt/wt) Ratio | 7.23 | 7.19 | 9.30 |
| Catalyst Residence Time, Sec. | 4.50 | 4.53 | 3.85 |
| Reactor Inlet Pressure, PSIG | 30.0 | 30 | 30 |
| Mole of Product/Mole Feed (Ex Coke) | 4.748 | 1.345 | 1.807 |
| Oil Partial Pressure, Inlet, psia | 25.5 | 36.1 | 35.6 |
| Tmix, ° F. C | 1009.5 | 1024.9 | 990.3 |
| Carbon, Spent Catalyst, % wt. | 1.197 | 1.303 | .890 |
| Sulfur, Spent Catalyst, % wt. | .0511 | .0486 | .0233 |
| Nitrogen, Spent Catalyst, % wt. | .013 | .013 | .0057 |
| Slip Ratio | 1.23 | 1.26 | 1.24 |
| Co-Cracking Agent | — | $CH_3OH$ | cis-2-Butene |
| Co-Cracking Agent, Wt.% of Resid | — | 25.4 | 101.0 |
| Molar Ratio, Co-Cracking Agent/Resid | — | 3.66 | 8.31 |
| Catalyst | ← 15 % REY zeolite → | | |

Table 6

| Run | Product Selectivities (Basis: 100g n-$C_{Feed}$) H-595 | | H-596 | | H-617 |
|---|---|---|---|---|---|
| Change In | | | | | |
| Resid g | 100.0 | | 100.0 | | 100.0 |
| Co-reactant g | — | ($CH_3OH$) : | 11.1[b] | cis-2-: | 101.0 |
| Total, g | 100.0 | | 111.1 | $C_4$ = | 201.0 |
| Products Out, g | | | | | |
| $C_5$+ Gasoline[a] | 43.73 | | 44.33 | | 51.54 |
| Total $C_4$ | 10.86 | | 11.00 | | 90.47 |
| Dry Gas | 9.73 | | 16.07 | | 20.14 |
| Coke | 9.47 | | 12.68 | | 18.11 |
| Cycle Oil[a] | 26.21 | | 27.01 | | 20.74 |
| Light Product Breakdown, g | | | | | |
| $H_2S$ | .19 | | .26 | | .28 |
| $H_2$ | .09 | | .19 | | .10 |
| $C_1$ | 1.37 | | 6.59 | | 2.37 |
| $C_2$ = | .82 | | 1.26 | | 1.77 |
| $C_2$ | .94 | | 1.26 | | 1.55 |
| $C_3$ = | 4.67 | | 5.38 | | 11.74 |
| $C_3$ | 1.65 | | 1.60 | | 2.37 |
| $C_4$ = | 5.02 | | 6.57 | | 63.40 |
| i-$C_4$ | 4.49 | | 3.56 | | 13.07 |
| N-$C_4$ | 1.35 | | .87 | | 14.01 |
| $C_5$= | 2.95 | | 4.86 | | 8.70 |
| i-$C_5$ | 4.60 | | 3.07 | | 7.98 |
| n-$C_5$ | 1.00 | | .69 | | .96 |
| Recovery, wt.% of feed | 90.81 | | 92.05[c] | | 92.32 |

Table 6-continued

| Run | Product Selectivities (Basis: 100g n-$C_{feed}$) H-595 | H-596 | H-617 |
|---|---|---|---|
| $H_2$-Factor | .33 | .18 | .16 |
| Gasoline Efficiency, Apparent[d] | 59.2 | 60.7 | 65.0 |

[a]~ 356° F. at 90% ASTM cut point.
[b]Basis is on complete removal of $H_2O$ from $CH_3OH$
[c]Traces only of dimethyl ether found in gaseous products.
[d]Defined as g. gasoline/100 g. oil - g. cycle oil × 100.

Table 7

| Run | Gasoline Inspections H-595 | H-596 | H-617 |
|---|---|---|---|
| Sp. Grav., 60° F. | .7513 | .7662 | .7620 |
| API Grav., 60° F. | 57.3 | 53.18 | 54.20 |
| Hydrocarbon Type, $C_5$-Free, Vol. % | | | |
| Paraffins | 38.2 | 28.2 | 35.8 |
| Olefins | 14.4 | 19.3 | 14.1 |
| Naphthenes | 10.5 | 8.8 | 6.8 |
| Aromatics | 36.8 | 43.7 | 43.4 |
| % H | 12.88 | 12.46 | 12.59 |
| MW | 108.44 | 116.10 | 106.5 |
| Distillation, ° F. | | | |
| 10% | | | '98 |
| 50% | | | 243 |
| 90% | | | 368 |

Table 8

| Run | Cycle Oil Inspections H-595 | H-596 | H-617 |
|---|---|---|---|
| Sp. Grav., 60° F. | 1.0551 | 1.0370 | 1.051 |
| API Gravity, 60° F. | 2.61 | 4.95 | 3.25 |
| Sulfur, % Wt. | 5.24 | 5.24 | — |
| Hydrogen, % Wt. | 7.90 | 8.34 | 7.35 |
| Refractive Index, $n_D70°$ | 1.607 | 1.598 | 1.627 |
| Hydrocarbon Type, Wt.% | | | |
| Paraffins | 5.2 | 4.8 | 6.8 |
| Mono-naphthenes | 1.7 | 1.6 | 5.5 |
| Poly-naphthenes | 4.0 | 4.1 | 7.9 |
| Aromatics | 89.2 | 89.6 | 79.8 |
| Naphthene/Aromatic (Wt/Wt) Ratio | .064 | .064 | .17 |
| Distillation, ° F. | | | |
| 10% | 478 | 490 | 504 |
| 50% | 633 | 682 | 705 |
| 90% | 892 | 922 | 862 |
| Aromatic Breakdown, Normalized, Wt.% | | | |
| Mono-aromatics | 10.8 | 15.8 | 16.6 |
| Di-aromatics | 44.5 | 46.6 | 28.7 |
| Tri-aromatics | 11.6 | 9.9 | 14.6 |
| Tetra-aromatics | 6.4 | 5.7 | 12.1 |
| Penta-aromatics | 1.3 | 1.4 | 4.7 |
| Sulfur Compounds | | | |
| Benzothiophenes | 12.2 | 8.6 | 6.9 |
| Dibenzothiophenes | 10.3 | 6.0 | 9.6 |
| Naphthobenzothiophenes | 2.8 | 2.2 | 6.2 |
| Other | 0.2 | 0.4 | .5 |
| Ratio, Diaromatics/Benzothiophene | 3.65 | 5.42 | 4.16 |

The process concept of this invention is particularly supported by the following examples. The examples include the cracking of a raw atmospheric resid (A) in the presence of methanol and (B) in the presence of cis-2-butene in a benchscale riser FCC pilot plant at 1000° F. using an equilibrium fluid zeolite-type catalyst.

The raw atmospheric resid (light Arab origin) briefly identified below showed the inspections provided in Table 4. Methanol was C. P. Grade, Baker.

EXAMPLE 4

Methanol (25.4 wt.% based on resid) and resid above identified were pumped from separate reservoirs to the inlet of the feed preheater of a 30 ft. bench scale riser FCC unit. These materials were intimately mixed in the feed preheater at 510° F, and then admitted to the riser inlet for contact with hot (1240° F.) catalyst (15% REY zeolite, 67.5 FAI) and catalytic reaction allowed to occur. The riser reactor inlet and mix temperature were 1000° F., ratio of catalyst to oil (Oil = resid + $CH_3OH$) was 7.2, catalyst residence time was 4.5 sec., riser inlet pressure was 30 psig, and ratio of catalyst residence time to oil residence time (slip) was 1.26. The riser effluent was then passed through a steam stripping chamber, and a gaseous effluent was separated from the spent catalyst containing 1.303 wt.% carbon. The gaseous and liquid products were collected, separated by distillation and analyzed. This run is H-596. Data for the operating conditions and mass balance, gasoline inspections and cycle oil inspections are shown in Tables 5, 6, 7 and 8, respectively, presented above.

A similar (control) run was made with resid only, with no methanol present (H-595). Analyses show the following improvements associated with the use of methanol when intimately mixed with and converted with resid in a riser fluid catalytic cracking unit:

1. Slightly better gasoline yield: Δ = +0.6 wt.%
2. Slightly better gasoline efficiency: Δ = +1.5 wt.%
3. Greatly improved gasoline quality: mass spectrographic "PONA" analysis shows less paraffins, more olefins and more aromatics:

| HC Type | Δ, Vol. % |
|---|---|
| P | − 10.0 |
| O | + 4.9 |
| N | − 1.7 |
| A | + 6.9 |

This much more olefinic and aromatic gasoline may be expected to have significantly higher octane (R+O) number.

4. More butenes (Δ = + 1.55), propylene (Δ = + 0.71), and more ethylene (Δ = + 0.44). These higher light olefin yields are useful as potential feed for high octane alkylate manufacture or chemical uses.

5. More $H_2$ gas (Δ = 0.1 wt.%). This process-generated $H_2$-gas can lessen refinery needs for outside $H_2$ purchase or reduce need for $H_2$-plant construction. Excess $H_2$ can be used in pretreaters, hydrotreaters, etc.

6. Higher hydrogen level in cycle oil (Δ = + 0.44); this higher hydrogen level imparts better burning qualities in fuel applications, or renders the stock more crackable in recycle operations. Also, some small degree of desulfurization has occurred since the ratio of diaromatics/benzothiophene (wt/wt) has increased from 3.65 to 5.42 with use of $CH_3OH$.

EXAMPLE 5

Cis-2-Butene (101.0 wt.% based on resid) and the light Arab pumped from separate reservoirs to the inlet of the feed preheater of a 30 ft. bench scale riser FCC unit. The stocks were intimately mixed in the feed preheater at 790° F. and then admitted to the riser inlet, where hot (1065° F.)catalyst (15% REY zeolite, 67.5 FAI) was admitted and catalytic reaction allowed to occur. Riser reactor inlet and mix temperature were 1000° F., ratio of catalyst to oil (oil = resid + butene) was 9.3, catalyst residence time was 3.9 sec., riser inlet pressure was 30 psig, and ratio of catalyst residence time to oil residence time (slip) was 1.24. Riser effluent then passed through a steam stripping chamber, and gaseous effluent was separated from a spent catalyst (0.890 wt.% carbon). The gaseous and liquid products were collected, separated by distillation and analyzed. This run is numbered H-617.

Data for the operating conditions and mass balance, gasoline inspections, and cycle oil inspections are also shown in Tables 5, 6, 7 and 8, respectively.

A similar (control) run was made with the light Arab resid only, with no olefin present (H-595). Our analyses show the following improvements associated with the use of very large amounts of cis-2-butene when intimately mixed with and co-cracked with resid in riser FCC unit:

1. Very much better gasoline yield: Δ = +7.81 wt.%, or about 18% higher gasoline yield than without the $C_4$-olefin.
2. Much greater (apparent) gasoline efficiency: Δ = + 5.8 wt.%.
3. Significantly improved gasoline quality: Mass spectroscopic "PONA" analysis shows less paraffins and more aromatics; this more hydrogen-deficient gasoline may be expected to have significantly higher octane number:

| HC Type | Δ, Vol. % |
|---|---|
| P | − 2.4 |
| O | − 0.3 |
| N | − 3.7 |
| A | + 6.6 |

4. The large amount of butene present in the reaction mix can be recycled to the process again if desired.
5. Very large amounts of isobutane are generated: Δ is + 8.58 wt.%; this can be used as alkylation feed.
6. Substantial amounts of n-butane are generated: Δ = + 12.66 wt.%; this can either be used for RVP control of gasoline or isomerized to iso-$C_4$ as alkylation feed.
7. Large amounts of propylene (Δ = + 7.07 wt.%), which can be used as alkylation feed, and ethylene (Δ = + 0.95 wt.%), which can be used for alkylation or chemicals.
8. More pentenes: Δ = + 5.75 wt.%. These are a valuable source of octane.
9. More isopentane (Δ = + 3.38 wt.%) and higher iso-$C_5$/n-$C_5$ ratio (8.3 with olefin vs. 4.6) (high octane source).
10. More gaseous $H_2S$ (Δ = + .09 wt.%); better desulfurization.
11. Higher naphthene/aromatic ratio in cycle oil, and slightly higher diaromatic/benzothiophene ratio.

Having thus generally described the invention and presented specific examples in support thereof, it is to be understood that no undue restrictions are to be imposed by reason thereof except as defined by the following claims.

We claim:

1. A method for converting residual hydrocarbons comprising greater than 1 ppm of nickel and vanadium as metal contaminants which comprises, mixing said metal contaminated residual hydrocarbons with at least 25 wt. percent of low molecular weight carbon hydrogen fragment contributing material of less than 5 carbon atoms and contacting the mixture with a crystalline zeolite cracking catalyst of a pore size opening within the range of 4 to 15 Angstroms under conditions providing a contact mix temperature within the range of 800° F. to 1200° F., providing a hydrocarbon residence time in contact with said catalyst within the range of 0.5 to 10 seconds and recovering a product of said conversion operation comprising improved yields of isobutane and aromatic gasoline than obtained in the absence of said carbon hydrogen fragment contributor.

2. The method of claim 1 wherein the catalyst comprises a faujasite crystalline zeolite combined with from about 2 to 15 weight percent of a smaller pore crystalline zeolite.

3. The method of claim 1 wherein the catalyst comprises a mixture of "Y" faujasite and ZSM-5 crystalline zeolite.

4. The method of claim 1 wherein the catalyst comprises mordenite crystalline zeolite.

5. The method of claim 1 wherein the carbonhydrogen fragment contributor is an olefin comprising at least 100 wt. percent of the feed mixture.

6. The method of claim 1 wherein conversion of the residual oil is effected at a temperature within the range of 900 to 1100° F. at a pressure less than 100 psig.

* * * * *

UNITED STATES PATENT AND TRADEMARK OFFICE

CERTIFICATE OF CORRECTION

PATENT NO. : 4,002,557

DATED : January 11, 1977

INVENTOR(S) : HARTLEY OWEN and PAUL B. VENUTO

It is certified that error appears in the above-identified patent and that said Letters Patent are hereby corrected as shown below:

| | |
|---|---|
| Column 2, Line 45. | After "include" insert -- improved --. |
| Column 2, Line 53. | "requirement" should be -- requirements --. |
| Column 4, Lines 17 & 18. | "8-1-5-A" should be -- 8-15-A --. |
| Column 4, Line 36. | "component" should be -- components --. |
| Column 13, Table III-A, Line 15. | "Yields (NLB on Total Feed) (c)" should be -- Yields (NLB on Total Feed) (e) --. |
| Columns 15 & 16, Table 6. | In the heading "(Basis: 100g n-$C_{feed}$)" should be -- (Basis: 100g Resid Feed) --. |
| Columns 15 & 16, Table 6. | Under heading Light Product Breakdown "N-$C_4$" should be -- n-$C_4$ --. |
| Columns 17 & 18, Table 6-continued. | In the heading "(Basis: 100g n-$C_{feed}$)" should be -- (Basis: 100g Resid Feed) --. |
| Column 19, Line 56. | After "from" eliminate -- a --. |

Signed and Sealed this

Nineteenth Day of April 1977

[SEAL]

*Attest:*

RUTH C. MASON
*Attesting Officer*

C. MARSHALL DANN
*Commissioner of Patents and Trademarks*